US007311642B2

(12) United States Patent
Li et al.

(10) Patent No.: US 7,311,642 B2
(45) Date of Patent: Dec. 25, 2007

(54) TRANSFORMABLE EXERCISE SYSTEM

(75) Inventors: Dorothy Li, 96 Russett Rd, West Roxbury, MA (US) 02132; Daniel Kern, Canton, MI (US)

(73) Assignee: Dorothy Li, Roxbury, MA (US)

( * ) Notice: Subject to any disclaimer, the term of this patent is extended or adjusted under 35 U.S.C. 154(b) by 213 days.

(21) Appl. No.: 11/026,344

(22) Filed: Dec. 30, 2004

(65) Prior Publication Data

US 2005/0164855 A1 Jul. 28, 2005

Related U.S. Application Data

(60) Provisional application No. 60/533,512, filed on Jan. 2, 2004.

(51) Int. Cl.
*A63B 26/00* (2006.01)

(52) U.S. Cl. ..... 482/142; 482/140; 297/135

(58) Field of Classification Search ..... 482/904, 482/142; D21/676, 686, 690; D6/396; 108/50.11; 297/135; 312/235.9, 341; 5/3, 2.1; 190/11
See application file for complete search history.

(56) References Cited

U.S. PATENT DOCUMENTS

| | | | | |
|---|---|---|---|---|
| 1,158,779 | A | 11/1915 | Bolger | |
| 2,097,273 | A | 10/1937 | Feist | |
| 4,205,876 | A | 6/1980 | Cetina | |
| 4,609,192 | A | 9/1986 | Bratcher | |
| 4,805,901 | A | 2/1989 | Kulick | |
| 4,925,245 | A | 5/1990 | Pendleton et al. | |
| D330,057 | S | 10/1992 | Saunders et al. | |
| 5,316,528 | A | 5/1994 | Ziparo | |
| 5,470,292 | A | 11/1995 | Simon | |
| 5,533,948 | A | 7/1996 | Wilkinson | |
| 5,536,072 | A | 7/1996 | Chang | |
| 5,575,742 | A | 11/1996 | Wu | |
| 5,591,105 | A | 1/1997 | Dalebout et al. | |
| 5,611,762 | A | 3/1997 | Kaye | |
| 5,660,257 | A * | 8/1997 | Douglas | 190/1 |
| 5,681,249 | A | 10/1997 | Endelman | |
| 5,697,870 | A | 12/1997 | Osborn | |
| 5,727,476 | A | 3/1998 | Priore, Sr. | |
| 5,842,955 | A | 12/1998 | Wilkinson | |
| 5,865,710 | A | 2/1999 | Wilson-Hyde | |
| 5,997,442 | A | 12/1999 | Cordes | |
| 6,063,007 | A | 5/2000 | Sithole | |
| 6,245,001 | B1 | 6/2001 | Siaperas | |
| 6,454,683 | B1 | 9/2002 | Kaye | |
| 2002/0078861 | A1 * | 6/2002 | Davis | 108/14 |
| 2003/0226477 | A1 * | 12/2003 | Karadizian et al. | 108/11 |

* cited by examiner

*Primary Examiner*—Lori Amerson
(74) *Attorney, Agent, or Firm*—Hamilton, Brook, Smith & Reynolds, P.C.

(57) ABSTRACT

A transformable exercise system includes a horizontal surface supported at opposite ends by legs, and defining a space below the horizontal surface and between the legs. The horizontal surface can be at a height suitable for use as a furniture item and as an exercise bench. A storage drawer can be positioned in the space between the legs. The storage drawer can be dimensioned to closely fit within the space and has a removable cover that is configured to also serve as an aerobic step.

19 Claims, 2 Drawing Sheets

TRANSFORMABLE EXERCISE SYSTEM

RELATED APPLICATION

This application claims the benefit of U.S. Provisional Application No. 60/533,512, filed Jan. 2, 2004. The entire teachings of the above application are incorporated herein by reference.

BACKGROUND

People who exercise in their homes, apartments or rooms sometimes do not have a lot of space for storing exercise equipment. Exercise benches are commonly used in fitness training but can require significant space.

SUMMARY

The present invention provides a transformable exercise system which can be used as an item of furniture, such as a coffee table or a chest, and then be converted for use as an exercise bench with an aerobic step.

In particular embodiments, the transformable exercise system can include a horizontal surface supported at opposite ends by legs, and defining a space below the horizontal surface and between the legs. The horizontal surface can be at a height suitable for use as a furniture item and as an exercise bench. A storage drawer can be positioned in the space between the legs. The storage drawer can be dimensioned to closely fit within the space and has a removable cover that is configured to also serve as an aerobic step.

In some embodiments, the horizontal surface can be rectangular in shape and can have a padded top surface. There can be two legs of pedestal construction having a rectangular cross section. The storage drawer can have rollers for pulling the drawer out of the space. The rollers can be on the bottom of the drawer. The drawer can have a first handle formed by a first cut out in a first side wall of the drawer and can have a second handle formed by a second cut out on a second side wall that is opposite to the first side wall for allowing the drawer to be pulled from the space from opposite sides of the exercise system. The removable cover can have a non-skid top surface, non-skid bottom surfaces on corner posts, and have handles formed by cut outs into opposite side walls.

The present invention can also include a method of transforming a transformable exercise system having a horizontal surface supported at opposite ends by legs, in defining a space below the horizontal surface and between the legs. The horizontal surface can be at a height suitable for use as a furniture item and as an exercise bench. The storage drawer can be positioned in the space between the legs. The storage drawer can be dimensioned to closely fit within the space and have a removable cover. The storage drawer can be pulled from the space and the removable cover can be removed and placed on the ground where the cover is configured to serve as an aerobic step.

BRIEF DESCRIPTION OF THE DRAWINGS

The foregoing and other objects, features and advantages of the invention will be apparent from the following more particular description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Figure 1:
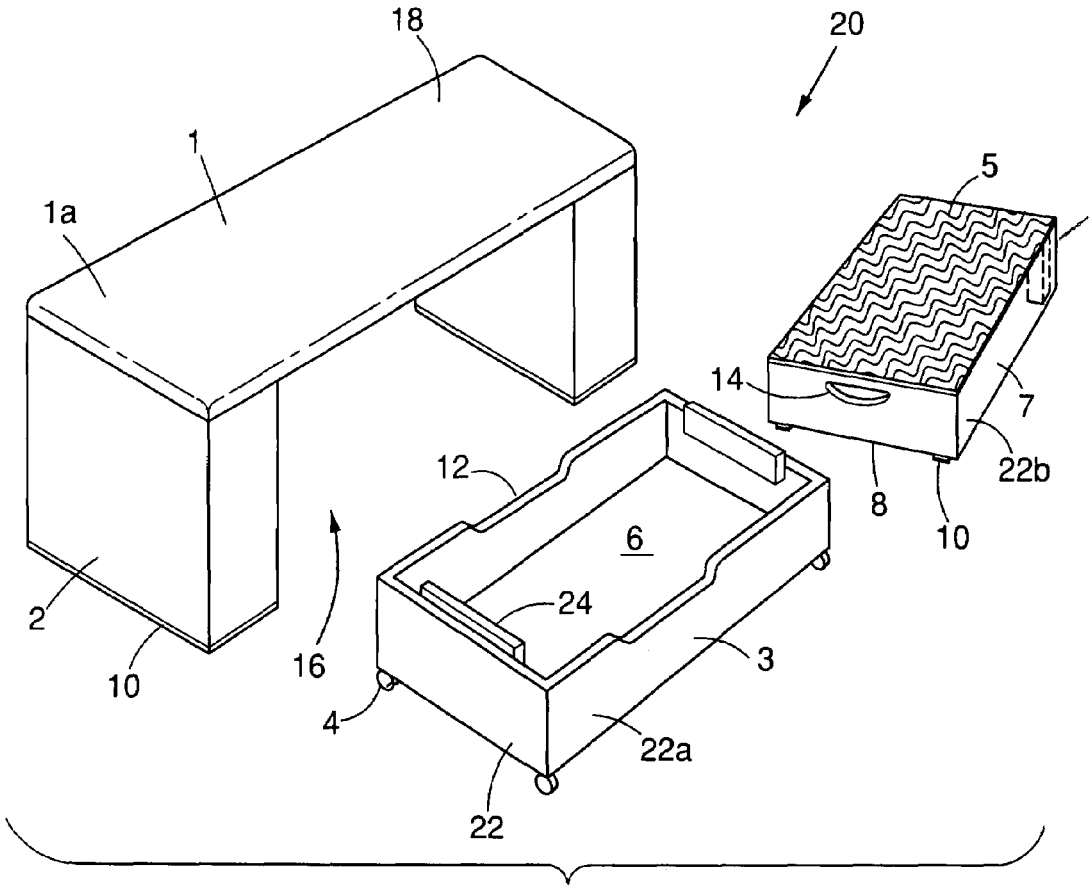
FIG. 1 is a perspective view of an embodiment of the transformable exercise system with the storage drawer pulled out from the main furniture portion and the top cover of the drawer removed.

FIGS. 1-4 depict one embodiment of the transformable exercise item or system 20 of the present invention. The system 20 can have a main or first furniture portion such as a table/bench 18, and a second furniture portion such as a storage drawer 22 which closely fits within a receiving space or compartment 16 defined below the top 1 and between the legs 2 of furniture portion 18. The top 1 can be generally rectangular in shape and is strong enough to support the weight of a person 30 (FIG. 3) and is at a height that is suitable for use both as an exercise bench, or a furniture item such as a coffee table, sitting bench, chest, etc. In some instances, the top 1 can have a padded top surface 1*a*. The legs 2 can be pedestal or post-type legs having a hollow rectangular cross section which are secured to the top 1 at opposite longitudinal ends of the top 1, and are sturdy enough to support the weight and horizontal forces when a person 30 sits on the top 1. The legs 2 can include non-skid pads 10, such as rubber, on the bottom.

The storage drawer 22 can be removable and can have a bottom drawer portion 22*a* and a top cover 22*b* that can be configured to form an aerobic step. The bottom drawer portion 22*a* can have four side walls 3 and a bottom 6 that is strong enough to support exercise weights. A series of wheels 4 can be included on the bottom of drawer portion 22*a* to allow drawer portion 22*a* to roll and be easily pulled out of the space 16 from under the furniture portion 18. The two opposed outward sides 3 of the bottom drawer portion 22*a* can have handles 12. In the embodiment shown, the handles 12 can be arched cut outs in the side walls 3. Alternatively, other suitably shaped cut outs can be used as handles or handle hardware can be secured to the side walls 3. In some embodiments, the wheels 4 can be omitted or the bottom drawer portion 22*a* can be movably secured to the legs 2 by sliding or rolling drawer hardware. Furthermore, in view that the bottom drawer portion 22*a* can serve as a storage bin, the bottom 6 and side walls 3 can be permanently secured between the legs 2 as a fixed storage bin.

Figure 5:
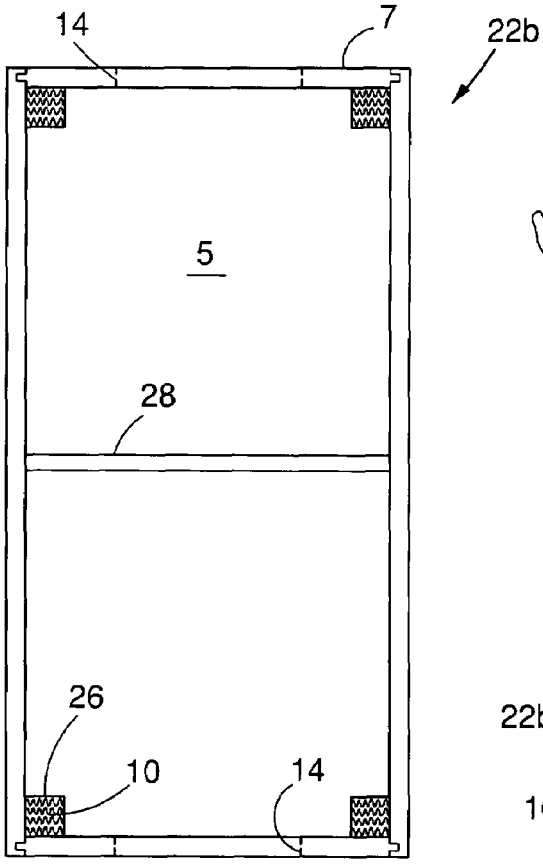
FIG. 5 is a bottom view of the top cover showing the interior.
Figure 4:
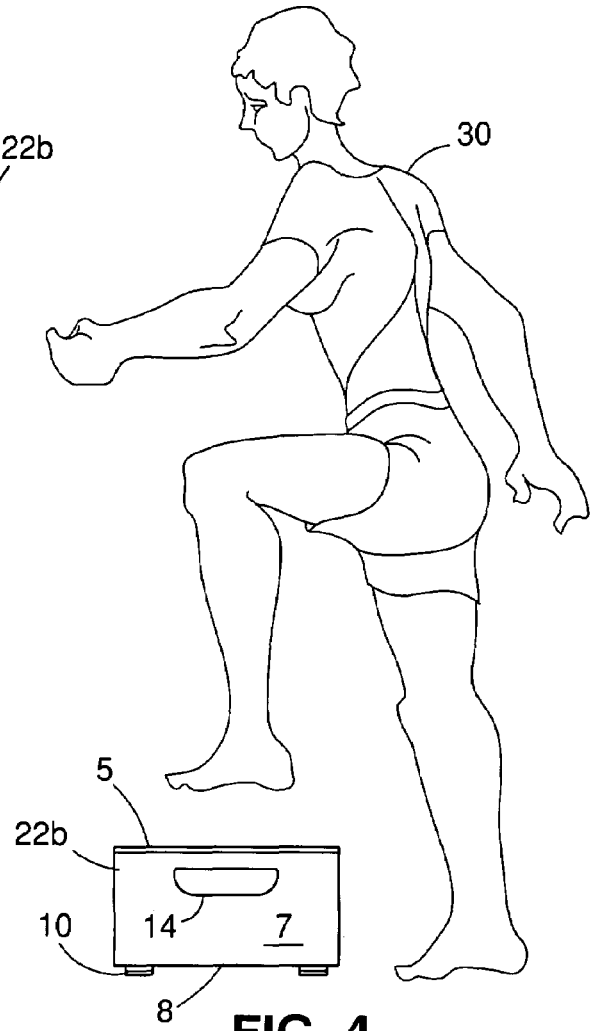
FIG. 4 is a side view of a user exercising on the top cover of the drawer when used as an aerobic step.

The top cover 22*b* fits on top of the bottom drawer portion 22*a* and can engage tabs 24 (FIG. 1) extending upwardly from the bottom drawer portion 22*a* for centering the top cover 22*b* on the bottom drawer portion 22*a*. The top cover 22*b* can be generally hollow and can have corner posts 26 (FIG. 5) with non-skid surfaces 10 extending from the bottom 8. The corner posts 26 can also help center the top cover 22*b* on the bottom drawer portion 22*a*. The top cover 22*b* has side walls 7 and a top 5 which are sturdy enough for a person 30 to step on the top cover 22*b* with minimal deflection during step aerobics. A center brace 28 can extend across the interior of the top cover 22*b* against the underside of the top 5 to provide additional strength and stiffness. The top 5 can have a non-skid upper surface, such as rubber, which is suitable for step aerobics. Two opposite side walls 7 such as on the longitudinal ends of the top cover 22*b* can have handles 14, which can be cut outs as shown, or hardware. The top cover 22*b* can be of a height that is suitable for step aerobics. Additionally, the top cover 22*b* can also be used as a step while on top of the bottom drawer portion 22*a* for extra height. In such a case, the wheels 4 are of the type that are lockable in place, or can be omitted. Alternatively, one or more extensions can be provided for varying the height of top cover 22*b* when used as an aerobic step.

In one embodiment, the system can be made primarily out of wood. The top 1 of the furniture portion 18 can be at a height of about 14-15 inches, and can be about 13-14 inches wide and about 36-37 inches long. The edges of the top 1 can be formed with a decorative profile. The foot print of the legs 2 can be about 12-13 inches long by about 5 inches wide. In some embodiments, the legs 2 can be formed with shelves for additional storage. The space 16 can be about 25 inches long and about 14 inches high. The bottom drawer portion 22*a* can be about 24.75 inches long (or about ¼ inch shorter than space 16), about 12-13 inches wide, and about 7-8 inches high. The wheels 4 can be made of hard rubber. The cut outs for the handles 12 can be arch-shaped about 8-9 inches long and about 1-2 inches high. The top cover 22*b* can have the same length and width dimensions as the bottom drawer portion 22*a* and can be about 5-6 inches high. The total height of the storage drawer can be about ½ inch less than the height of the space 16. The cut outs for the handles 14 can be arch-shaped about 6-7 inches long and about 1-2 inches high. Although wood is a common material for system 20, other suitable materials can be employed, such as metals (for example, aluminum and steel), or plastics, or combinations of wood, metal, and plastics.

Figure 2:
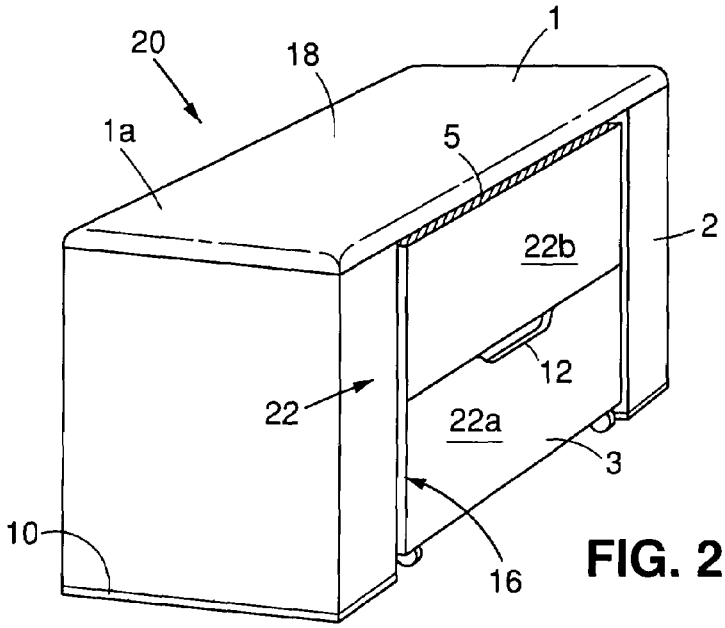
FIG. 2 is a perspective view of the transformable exercise item of FIG. 1 with the storage drawer and top cover in place under the main furniture portion.

When not being used by a person 30 as an exercise device, the system 20 can be stored in plain sight to look like a coffee table, a sitting bench, a hope chest, or some other piece of furniture. Referring to FIG. 2, the system 20 can be neatly assembled together. The top cover 22*b* fits snugly onto the top of the bottom drawer portion 22*a*. This combination can then be rolled under the furniture portion 18. With the storage drawer 22 fitting closely within space 16, the combination of the furniture portion 18 and the storage drawer 22 can have the appearance of being a single unit. The side walls 3 of the bottom drawer portion 22*a* can extend downwardly to substantially hide the wheels 4. The storage drawer 22 can be used to store complimentary exercise equipment such as video tapes, hand weights, etc.

Figure 3:
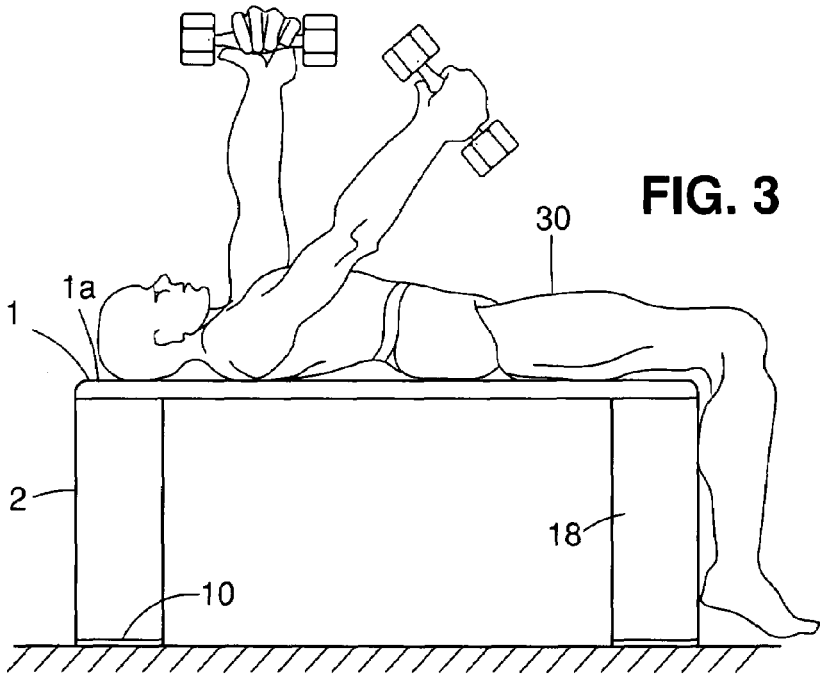
FIG. 3 is a side view of a user exercising on the main furniture portion.

When being used as an exercise device, the person 30 can lie down to perform varying exercise routines. Referring to FIG. 3, the top 1 of the furniture portion 18 can support the person's 30 back. The legs 2 do not move relative to the bench top 1. The person 30 can also sit on the top 1 while performing other exercise routines. The top cover 22*b* can be used as a step to perform exercise routines such as step aerobics.

While this invention has been particularly shown and described with references to particular embodiments thereof, it will be understood by those skilled in the art that various changes in form and details may be made therein without departing from the scope of the invention encompassed by the appended claims.

For example, although particular dimensions have been given for one embodiment, it is understood that the dimensions can vary depending upon the application at hand. In addition, furniture portion 18 and storage drawer 22 can be arranged in a room as separate furniture items. For example, furniture item 18 can be arranged as a table, bench, desk, etc., and the storage drawer 22 can be separately arranged as a rollout table, sitting bench, ottoman, chest, etc. on wheels. In some instances, furniture portion 18 can also be on wheels. In some embodiments, the storage drawer 22 can be used as the exercise bench. In such embodiments, the furniture item 18 does not have to be used as an exercise bench and can have increased height and/or width.

What is claimed is:

1. A transformable exercise system comprising:

a horizontal surface supported at opposite ends by legs, and defining a space below the horizontal surface and between the legs, the horizontal surface being at a height suitable for use as a furniture item and as an exercise bench; and a storage drawer positioned between the legs in said space, the storage drawer being dimensioned to closely fit within said space and having a removable cover that is configured to also serve as an aerobic step, the cover having a construction with a strength that withstands a person's weight performing step aerobics, the cover having rigid side walls and corner posts extending from a bottom of the cover, two opposed tabs extend upwardly from the storage drawer for engaging the side walls of the cover, the corner posts and the opposed tabs centering the cover on the storage drawer.

2. The transformable exercise system of claim 1 in which the horizontal surface is rectangular in shape.

3. The transformable exercise system of claim 2 in which the horizontal surface has a padded top surface.

4. The transformable exercise system of claim 2 in which there are two legs of pedestal construction having a rectangular cross section.

5. The transformable exercise system of claim 4 in which the storage drawer has rollers for pulling the drawer out of said space.

6. The transformable exercise system of claim 5 in which the storage drawer has a bottom, the rollers being on the bottom of the drawer.

7. The transformable exercise system of claim 5 in which the drawer has a first handle formed by a first cutout in a first side wall of the drawer.

8. The transformable exercise system of claim 7 in which the drawer has a second handle formed by a second cutout on a second side wall that is opposite to the first side wall for allowing the drawer to be pulled from said space from opposite sides of the exercise system.

9. The transformable exercise system of claim 8 in which the removable cover has a non-skid top surface, non-skid bottom surfaces on the corner posts, and handles formed by cutouts in two opposite side walls.

10. A method of forming a transformable exercise system comprising:

supporting a horizontal surface at opposite ends by legs, and defining a space below the horizontal surface and between the legs, the horizontal surface being at a height suitable for use as a furniture item and as an exercise bench; and positioning a storage drawer between the legs in said space, the storage drawer being dimensioned to closely fit within said space and having a removable cover that is configured to also serve as an aerobic step, the cover having a construction with a strength that withstands a person's weight performing step aerobics, the cover having rigid side walls and corner posts extending from a bottom of the cover, two opposed tabs extend upwardly from the storage drawer for engaging the side walls of the cover, the corner posts and the opposed tabs centering the cover on the storage drawer.

11. The method of claim 10 further comprising forming the horizontal surface to be rectangular in shape.

12. The method of claim 11 further comprising providing the horizontal surface with a padded top surface.

13. The method of claim 11 further comprising providing two legs of pedestal construction having a rectangular cross section.

14. The method of claim 13 further comprising providing the storage drawer with rollers for pulling the drawer out of said space.

15. The method of claim 14 in which the storage drawer has a bottom, the method further comprising positioning the rollers on the bottom of the drawer.

16. The method of claim 14 further comprising providing the drawer with a first handle formed by a first cutout in a first side wall of the drawer.

17. The method of claim 16 further comprising providing the drawer with at second handle formed by at second cutout on a second side wall that is opposite to the first side wall for allowing the drawer to be pulled from said space from opposite sides of the exercise system.

18. The method of claim 17 further comprising providing the removable cover with a non-skid top surface, non-skid bottom surfaces on the corner posts, and handles formed by cutouts in two opposite side walls.

19. A method of transforming a transformable exercise system having:

a horizontal surface supported at opposite ends by legs, and defining at space below the horizontal surface and between the legs, the horizontal surface being at a height suitable for use as a furniture item and as an exercise bench, and a storage drawer positioned between the legs in said space, the storage drawer being dimensioned to closely fit within said space and having a removable cover, the method comprising:

pulling the storage drawer from said space; and removing the removable cover and placing the cover on the ground, the cover being configured to serve as an aerobic step, the cover having a construction with a strength that withstands a person's weight performing step aerobics, the cover having rigid side walls and corner posts extending from a bottom of the cover, two opposed tabs extend upwardly from the storage drawer for engaging the side walls of the cover, the corner posts and the opposed tabs centering the cover on the storage drawer.

* * * * *

UNITED STATES PATENT AND TRADEMARK OFFICE

CERTIFICATE OF CORRECTION

PATENT NO. : 7,311,642 B2
APPLICATION NO. : 11/026344
DATED : December 25, 2007
INVENTOR(S) : Dorothy Li and Daniel Kern It is certified that error appears in the above-identified patent and that said Letters Patent is hereby corrected as shown below:

Column 5, Claim 17, line 22, delete “at” after “with” and insert --a--
Column 5, Claim 17, line 22, delete “at” after “by” and insert --a--
Column 6, Claim 19, line 6, delete “at” after “defining” and insert --a--

Signed and Sealed this

Twenty-seventh Day of May, 2008

JON W. DUDAS
*Director of the United States Patent and Trademark Office*